US007451736B2

(12) United States Patent
Migaud et al.

(10) Patent No.: US 7,451,736 B2
(45) Date of Patent: Nov. 18, 2008

(54) OIL PAN FOR AN INTERNAL COMBUSTION ENGINE

(75) Inventors: Jerome Migaud, Vitre (FR); Gerald De Cara, Chateau Gontier (FR)

(73) Assignee: Mann & Hummel GmbH, Ludwigsburg (DE)

( * ) Notice: Subject to any disclaimer, the term of this patent is extended or adjusted under 35 U.S.C. 154(b) by 43 days.

(21) Appl. No.: 11/797,628

(22) Filed: May 4, 2007

(65) Prior Publication Data

US 2007/0289569 A1 Dec. 20, 2007

(30) Foreign Application Priority Data

May 4, 2006 (FR) ..... 06 51593

(51) Int. Cl.
*F02B 77/00* (2006.01)

(52) U.S. Cl. ..... 123/195 C; 184/6.5

(58) Field of Classification Search ..... 123/195 C; 184/6.5

See application file for complete search history.

(56) References Cited

U.S. PATENT DOCUMENTS 6,290,843 B1 9/2001 Lee et al.

FOREIGN PATENT DOCUMENTS

| | | |
|---|---|---|
| DE | 197 35 444 A1 | 1/1999 |
| EP | 1 526 258 A1 | 4/2005 |
| FR | 1 021 184 A | 2/1953 |

OTHER PUBLICATIONS

European Search Report dated Aug. 17, 2007 with an English translation of the pertinent portions (Six (6) pages).

*Primary Examiner*—Noah P. Kamen
(74) *Attorney, Agent, or Firm*—Crowell & Moring LLP

(57) ABSTRACT

An oil pan for attachment to the lower wall of the engine block housing of an internal combustion engine by bolts in such a way that lubricating oil is stored in the oil pan and transported from the oil pan to various parts of the engine to be lubricated by a suction line connected to an oil pump, in which excess oil flows back directly into the oil pan. The oil pan has a pan body (1) which is formed of a synthetic material and is closed along its upper portion by a connecting plate (2), also formed of a synthetic material, in which each of the two surfaces of the connecting plate is provided with a circumferential seal (8,9) that is cast onto the plate to ensure a tight seal between the pan body (1) and the engine block. The bottom portion of the connecting plate (2) extends as a tubular connecting piece (5), which is provided at its free end with a filter screen (6), and which forms a segment of the suction line.

6 Claims, 3 Drawing Sheets

OIL PAN FOR AN INTERNAL COMBUSTION ENGINE

BACKGROUND OF THE INVENTION

The present invention relates to an oil pan which can be bolted to a lower wall of an engine block housing of an internal combustion engine such that lubricating oil is stored in the pan and transported from the pan to various parts of the engine to be lubricated by a suction line connected to an oil pump.

SUMMARY OF THE INVENTION

A substantial feature of the oil pan according to the invention is the presence of the connecting plate formed of a synthetic material. This connecting plate represents an interface that ensures the necessary tightness between the pan body and the engine block due to the presence of two circumferential seals, which are cast onto its respective surfaces, and simultaneously enables the lubricating oil in the interior of the pan body to be withdrawn by suction by the oil pump.

This connecting plate must of course be provided with passages for the oil to flow back into the pan body and with holes for the shanks of the fastening bolts of the oil pan on the engine block housing.

The pan body comprises an element in the form of a vessel having a lower wall which is inclined and which is provided with an outlet opening at its lower end, the opening being sealed with a cap or plug.

The oil pan according to the invention is distinguished from conventional aluminum oil pans by its lower weight and by substantially lower production and assembly costs.

In accordance with one preferred feature of the invention, the pan body is formed by assembling two shells, i.e., a bottom shell in the form of a vessel and a top shell which is welded to the vessel and comprises the connecting plate.

The connecting plate and the top shell are thus located between the bottom shell and the engine block of the internal combustion engine.

These two shells are preferably joined by non-contact welding using a hot plate.

A welding process of this type has the advantage that very small weld seams are obtained, especially compared to conventional vibration welding.

The embodiment of the oil pan according to the invention can have a substantially larger capacity than comparable conventional oil pans currently offered on the market.

In accordance with another feature of the invention, the lower wall of the bottom shell extends upwardly by means of tubular columns extending parallel to each other and having a shoulder at their upper end, which forms a stop for the head of the attachment bolt of the oil pan on the engine block housing.

The top shell and the connecting plate are provided with holes arranged in pairs for the shanks of these bolts so that they can be bolted to the lower wall of the engine block housing and press together the two circumferential seals that are cast onto the connecting plate between the top shell and the engine block housing to ensure radial tightness between the oil pan and the engine block.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

It should be noted that in connection with this description, the terms "top," "bottom," "above" and "below" refer to the orientation of the oil pan in normal operating position mounted on an engine block.

Figure 1:
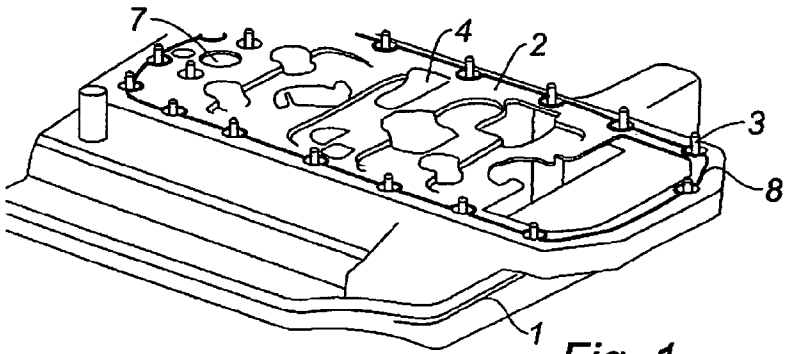
FIG. 1 is a perspective view of an oil pan according to the present invention.

According to FIG. 1, the oil pan comprises a pan body 1, which is formed of a synthetic material (e.g., plastic) and is closed at the top by a connecting plate 2, which is also formed of a synthetic material. The pan body 1 is fixed to the engine block housing of the internal combustion engine (not shown in the figures) using the attachment bolts 3. As will be described in greater detail below, the connecting plate 2 is located between the pan body 1 and the engine block housing.

Figure 2:
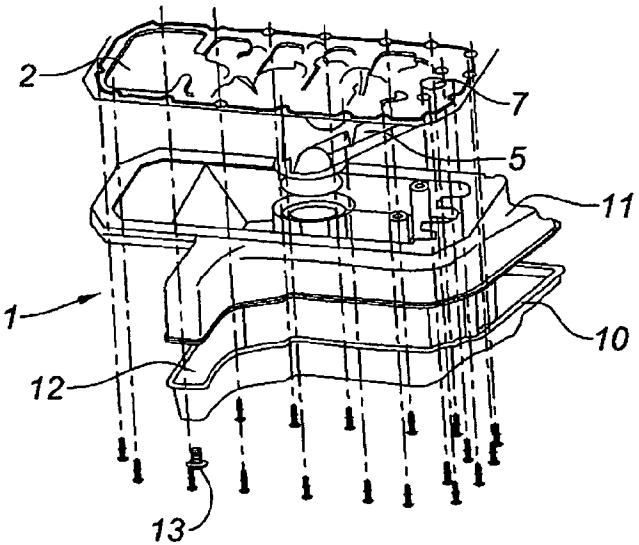
FIG. 2 is an exploded view of the oil pan of FIG. 1.
Figure 4:
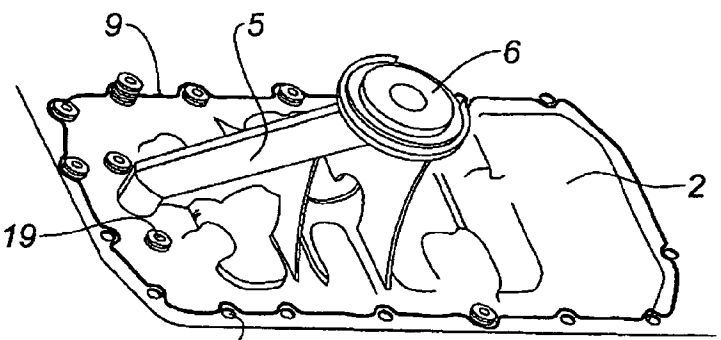
FIG. 4 is a perspective view of the bottom surface of the connecting plate.

According to FIGS. 2 and 4, the bottom surface of the connecting plate 2 extends as a tubular connecting piece 5, which surrounds an intake opening 7. The free end of the tubular connecting piece is provided with a filter screen 6. This tubular connecting piece 5 forms a segment of a suction line connected to an oil pump, which is not shown in the figures, to conduct the oil that is stored in the pan body 1 to the various parts of the engine that must be lubricated.

Openings 4 are drilled into the surface of the connecting plate 2 to enable the excess oil to flow back into the pan body 1.

As shown in FIGS. 1 and 4, the connecting plate 2 is provided with a circumferential seal 8, 9 on each of its sides, or the seals are cast onto it.

The connecting plate 2 is furthermore provided with a number of holes 19, 20 along its periphery, which are intended to receive the shanks of the attachment bolts. Some of these holes 19 are located on the inside of the circumferential seals 8, 9, whereas the other holes 20 are located on the outside of these seals. When the pan body 1 is bolted to the engine block housing, the two circumferential seals 8, 9 are compressed to ensure a tight seal in this area.

Figure 3:
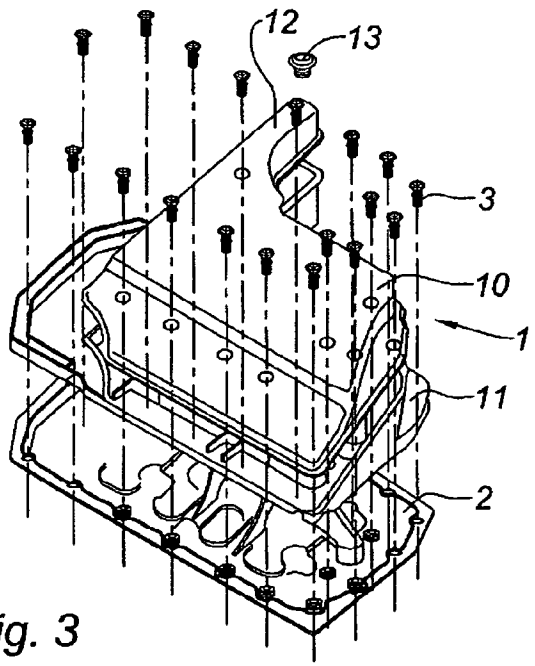
FIG. 3 is an exploded view of the oil pan corresponding to that shown in FIG. 2 but viewed from below the oil pan.
Figure 5:
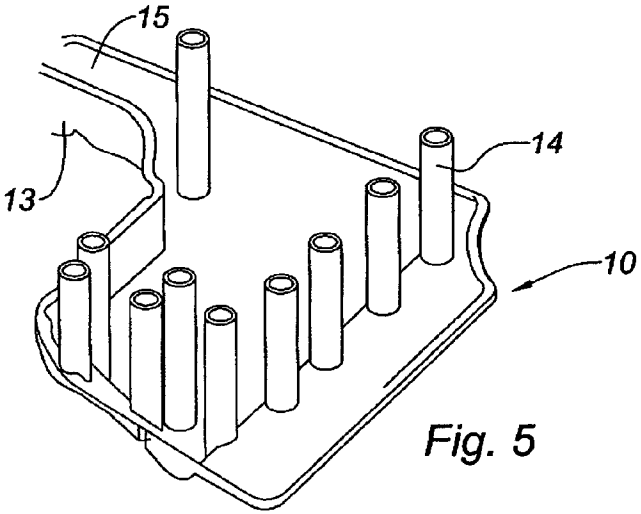
FIG. 5 is a perspective view of the top surface of the bottom shell.
Figure 6:
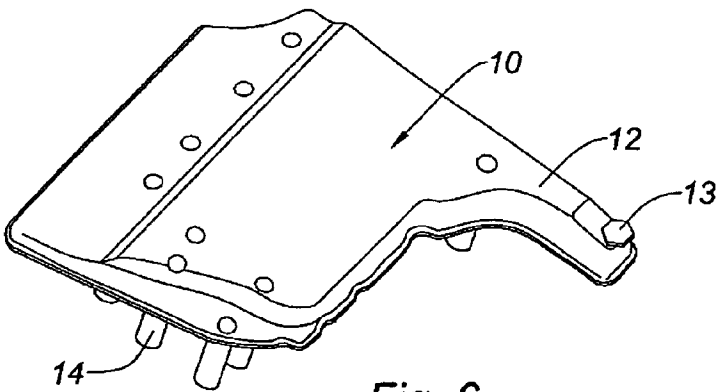
FIG. 6 is a perspective view of the bottom surface of the bottom shell.

According to FIGS. 2 and 3, the pan body 1 is formed by assembling a bottom shell in the form of a vessel 10 and a top shell 11, which is welded to the vessel along its periphery. The bottom shell 10 is shown in greater detail in FIGS. 5 and 6, and the top shell 11 is shown in greater detail in FIGS. 7 and 8.

According to FIGS. 2, 3, 4, 5 and 6, the bottom surface of the bottom shell 10 is inclined and extends laterally via a channel 12 to a low lying point that is equipped with an outlet opening sealed by a cap 13. The bottom surface of the bottom shell 10 also extends upwardly by a number of tubular columns 14 extending parallel, the purpose of which is to receive the attachment bolts 3 of the pan body 1 for insertion into the engine block housing.

Figure 7:
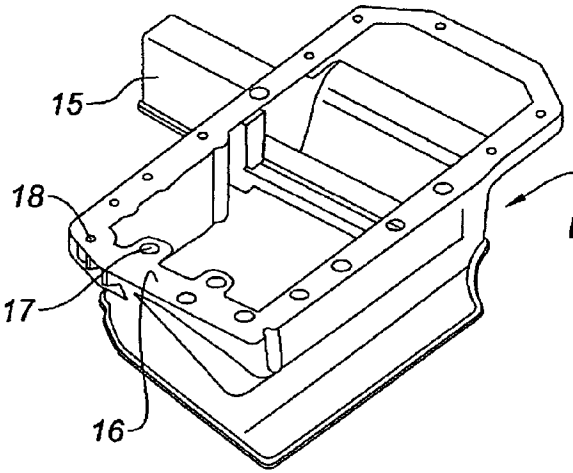
FIG. 7 is a perspective view of the top surface of the top shell.
Figure 8:
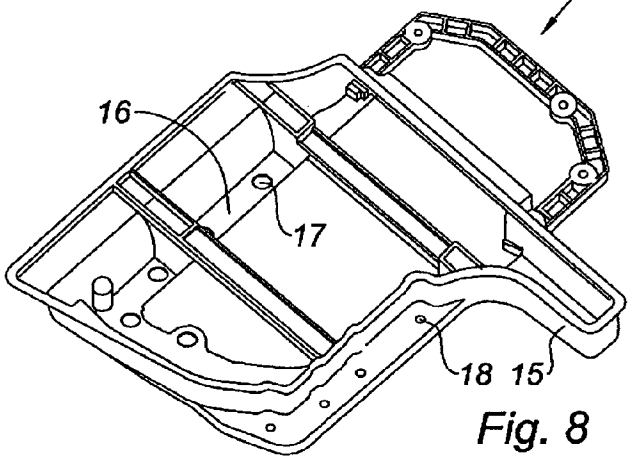
FIG. 8 is a perspective view of the bottom surface of the top shell.

According to FIGS. 7 and 8, the top shell 11 has a geometry that complements that of the bottom shell 10 and also extends laterally by a rib 15, which corresponds to the channel 12. The top shell 11 moreover has a ring 16 along its periphery, which is provided with holes that correspond to the holes 19, 20 formed in the connecting plate 2 and receive the shanks of the attachment bolts 3.

According to FIGS. 2 and 3 a portion of the ring 16 of the top shell 11 protrudes laterally beyond the bottom shell 10. The pairs of holes 18, 20 which are formed in this protruding portion and lie outside the circumferential seals 8, 9 directly receive the attachment bolts 3. The other pairs of holes 17, 19 are each located on the right side of the upper end of a tubular column 14 of the bottom shell 10 within the circumferential seals 8, 9.

Figure 10:
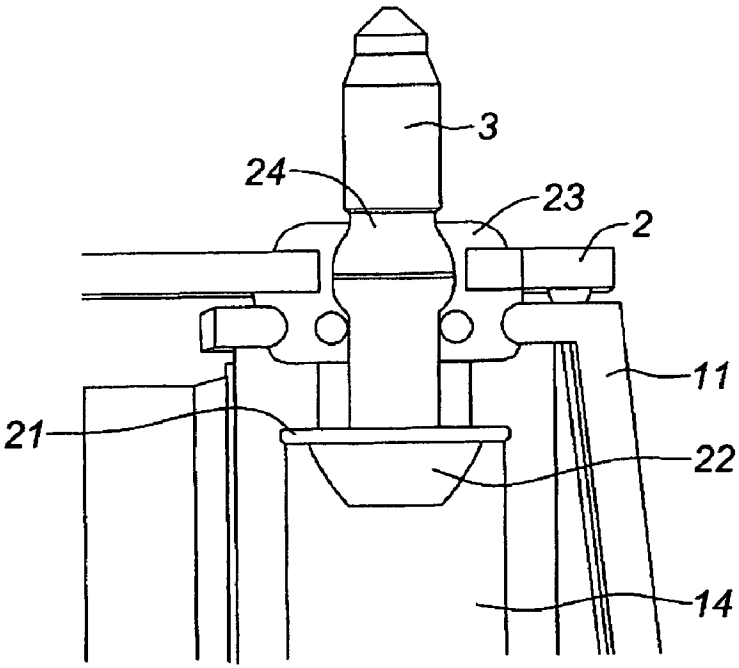
FIG. 10 is a detail view of an attachment bolt resting against the shoulder of the tubular column.
Figure 9:
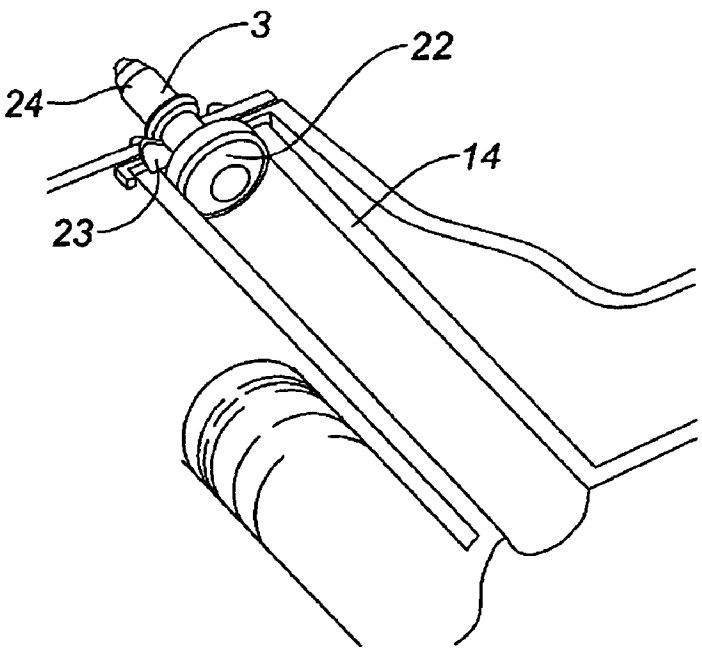
FIG. 9 is a half section showing a tubular column.

According to FIGS. 9 and 10, the tubular columns 14 are provided with a shoulder 21 at their upper end, which serves as a stop for the head 22 of an attachment bolt 3.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An oil pan for attachment by bolts to a lower wall of an engine block housing of an internal combustion engine such that lubricating oil is stored in the oil pan and transported through a suction line connected to an oil pump from the oil pan to various parts of the engine to be lubricated, wherein excess oil flows back directly into the oil pan, and wherein the oil pan comprises a pan body formed of a synthetic resin material which is closed along an upper portion thereof by a connecting plate also formed of a synthetic resin material, said connecting plate having two major surfaces each of which is provided with a circumferential seal cast onto the plate to ensure tight sealing between the pan body and the engine block, and wherein an lower portion of the connecting plate extends as a tubular connecting piece, which is provided with a filter screen at its free end and which forms a segment of the suction line.

2. An oil pan according to claim 1, wherein the pan body is formed by assembling two shells, one of said shells being a bottom shell in the form of a vessel, and the other of said shells being a top shell which is welded onto the vessel and receives the connecting plate.

3. An oil pan according to claim 2, wherein the pan body has a greater oil capacity than a conventional oil pan of corresponding dimensions made of aluminum or sheet metal.

4. An oil pan according to claim 2, wherein the lower wall of the bottom shell extends upwardly by a number of parallel tubular columns, each of said columns having a collar at the upper end thereof which forms a stop for the head of an attachment bolt for securing the oil pan to the engine block housing.

5. An oil pan according to claim 4, wherein the top shell and the connecting plate are provided with pairs of holes for receiving shanks of the attachment bolts.

6. An oil pan according to claim 5, wherein the seals are integrated directly into the connecting plate.

* * * * *